US011011872B2

(12) United States Patent
Fu

(10) Patent No.: US 11,011,872 B2
(45) Date of Patent: May 18, 2021

(54) INSERTING/REMOVING ASSEMBLY

(71) Applicant: Wistron Corporation, New Taipei (TW)

(72) Inventor: Zhao-Ping Fu, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/520,284

(22) Filed: Jul. 23, 2019

(65) Prior Publication Data

US 2020/0274293 A1 Aug. 27, 2020

(30) Foreign Application Priority Data

Feb. 26, 2019 (CN) ..... 201910142947.9

(51) Int. Cl.
*H01R 13/629* (2006.01)
*H01R 12/72* (2011.01)

(52) U.S. Cl.
CPC ..... *H01R 13/62938* (2013.01); *H01R 12/721* (2013.01)

(58) Field of Classification Search
CPC ..... H01R 13/62938; H01R 13/62944; H01R 12/721
See application file for complete search history.

(56) References Cited

U.S. PATENT DOCUMENTS 5,425,169 A * 6/1995 Steinman ..... B25B 27/02 29/267
5,657,204 A * 8/1997 Hunt ..... H05K 7/1409 361/752
6,625,039 B2 * 9/2003 Barringer ..... H05K 9/0062 174/377
6,698,937 B2 * 3/2004 Grimes ..... G02B 6/3825 385/53
6,926,548 B2 * 8/2005 Reasoner ..... H01R 13/62933 361/789
7,435,114 B2 * 10/2008 Desrosiers ..... G06F 1/186 439/157
7,663,889 B2 * 2/2010 Lajara ..... G06F 1/185 361/759
9,214,749 B2 * 12/2015 Li ..... H05K 7/1489
9,370,118 B2 * 6/2016 Li ..... H05K 7/1409
(Continued)

FOREIGN PATENT DOCUMENTS

CN 102738685 10/2012
CN 105552644 5/2016

OTHER PUBLICATIONS

"Office Action of Taiwan Counterpart Application," dated Oct. 18, 2019, p. 1-p. 6.

(Continued)

*Primary Examiner* — Briggitte R. Hammond
(74) *Attorney, Agent, or Firm* — JCIPRNET

(57) ABSTRACT

An inserting/removing assembly including a base, a carrier and a handle is provided. The base is for carrying an inserting/removing part having a connector. The carrier is disposed on the base and has a fixing portion for fixing the connector. The handle is pivotally disposed on the base, and the carrier is located between the base and the handle. The handle is linked with the carrier such that the connector fixed on the fixing portion is moved relative to the base with the carrier.

16 Claims, 6 Drawing Sheets

(56) References Cited

U.S. PATENT DOCUMENTS

| | | | | |
|---|---|---|---|---|
| 9,373,914 | B2 * | 6/2016 | Li | H01R 13/629 |
| 9,674,978 | B2 * | 6/2017 | Wu | G06F 1/185 |
| 2012/0240704 | A1 * | 9/2012 | Li | H05K 7/1409 74/412 R |
| 2014/0254086 | A1 | 9/2014 | Li et al. | |

OTHER PUBLICATIONS

"Office Action of China Counterpart Application", dated Jan. 20, 2021, p. 1-p. 6.

* cited by examiner

INSERTING/REMOVING ASSEMBLY

CROSS-REFERENCE TO RELATED APPLICATION

This application claims the priority benefit of China application serial no. 201910142947.9, filed on Feb. 26, 2019. The entirety of the above-mentioned patent application is hereby incorporated by reference herein and made a part of this specification.

BACKGROUND

Field of the Disclosure

The disclosure relates to an inserting/removing assembly.

Description of Related Art

In the technology related to electronic device, typically a card-like electronic component such as an interface card or an expansion card connected to the mainboard is additionally provided. The card-like electronic component is, for example, inserted into a slot disposed on the mainboard, and such card-like electronic component can be further connected to a wire (for example, a transmission line having a connector). The existing assembling method is that the connector of the wire is first inserted into the connection portion of the card-like electronic component, and then the wire (or further includes a bracket of the wire) is disposed in the housing while the card-like electronic component is inserted into the slot on the mainboard. That is, the card-like electronic component and the wire connected together are disposed into the housing.

However, since there are other electronic components, such as a memory module, disposed in the server, when the slot to be inserted by the card-like electronic component is close to the edge (e.g., close to sidewall) of the housing and adjacent to other electronic components (e.g., memory module), the mounting area for the card-like electronic component and the wire is very narrow, which makes it difficult to simultaneously insert the card-like electronic component into the slot on the mainboard and dispose the wire (or further includes a bracket of the wire) into the housing. In addition, since the mounting area for the wire is narrow, the configuration of disposing the wire into the housing is also likely to cause the wire to be squeezed by the housing or other components and become detached or damaged, which consequently causes the wire to break and thus the electronic device cannot operate normally. When the card-like electronic component or the wire is to be repaired or updated (i.e., removing card-like electronic component and/or wire) in the future, the repairing or updating action has to be performed in the narrow mounting area, and it is also difficult to remove the card-like electronic component from the slot and/or remove the wire (or further includes the bracket of the wire) from the housing.

SUMMARY

The present disclosure provides an inserting/removing assembly capable of performing an insertion/removal operation of an inserting/removing part in an easy and labor-saving manner.

An inserting/removing assembly in an embodiment of the disclosure includes a base, a carrier and a handle. The base is for carrying an inserting/removing part having a connector. The carrier is disposed on the base and has a fixing portion for fixing the connector. The handle is pivotally disposed on the base, and the carrier is located between the base and the handle. The handle is linked with the carrier such that the connector fixed on the fixing portion is moved relative to the base with the carrier.

Based on the above, the inserting/removing assembly in the embodiment of the present disclosure is designed by pivoting the handle to the base and the handle is linked with the carrier, such that the carrier between the base and the handle is driven by the handle to move relative to the base. In this way, when the inserting/removing part is carried on the base and the connector of the inserting/removing part is fixed on the fixing portion of the carrier, by operating the handle, it is possible to drive the connector fixed on the fixing portion to move relative to the base with the carrier and perform the insertion/removal operation of the inserting/removing part. In this manner, the inserting/removing part of the disclosure can perform the insertion/removal operation of the inserting/removing part in an easy and labor-saving manner.

In order to make the aforementioned features and advantages of the disclosure more comprehensible, embodiments accompanying figures are described in detail below.

DESCRIPTION OF EMBODIMENTS

Figure 1:
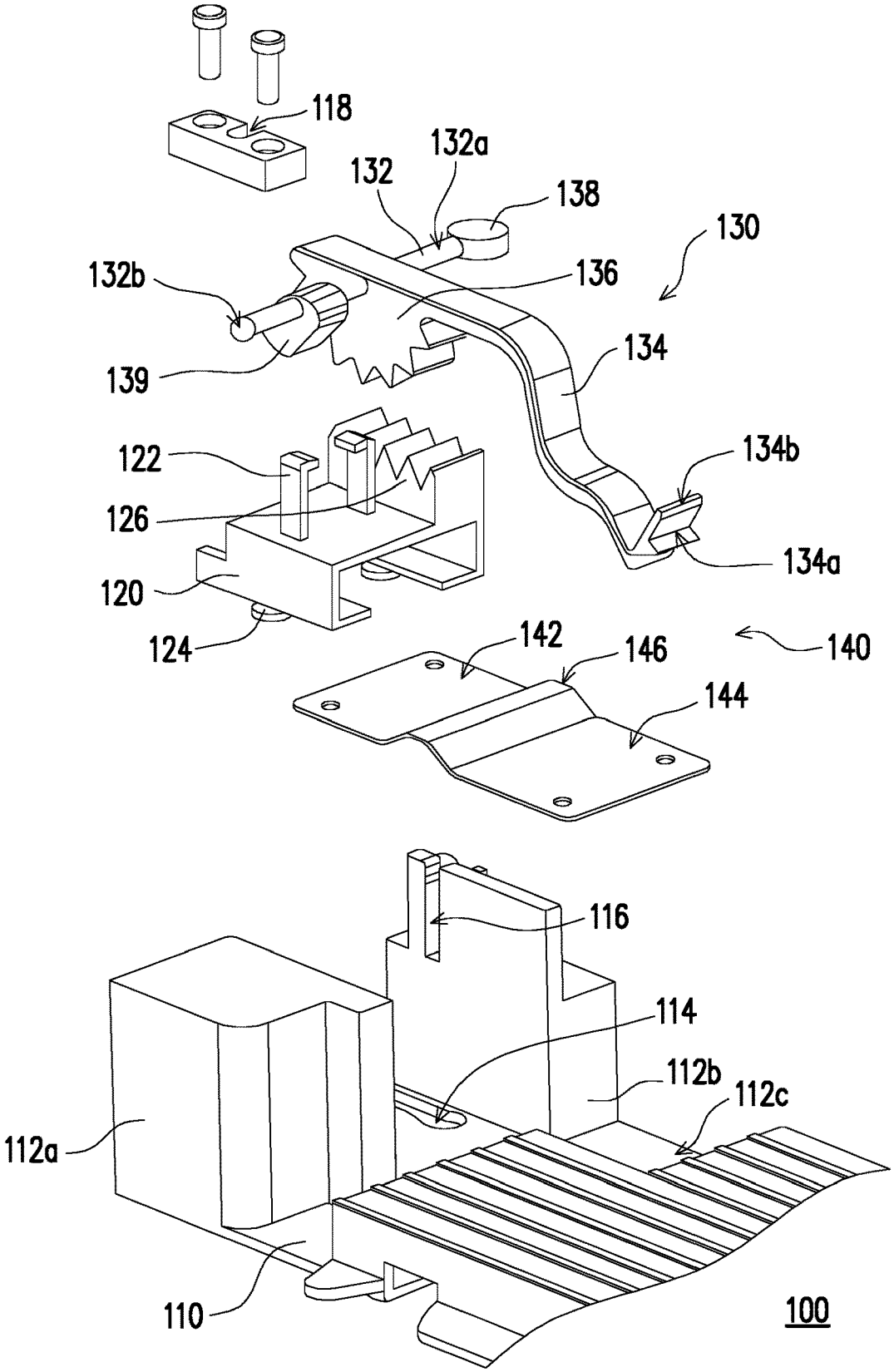
FIG. 1 is a schematic explosive view of an inserting/removing assembly of an embodiment of the present disclosure.
Figure 2:
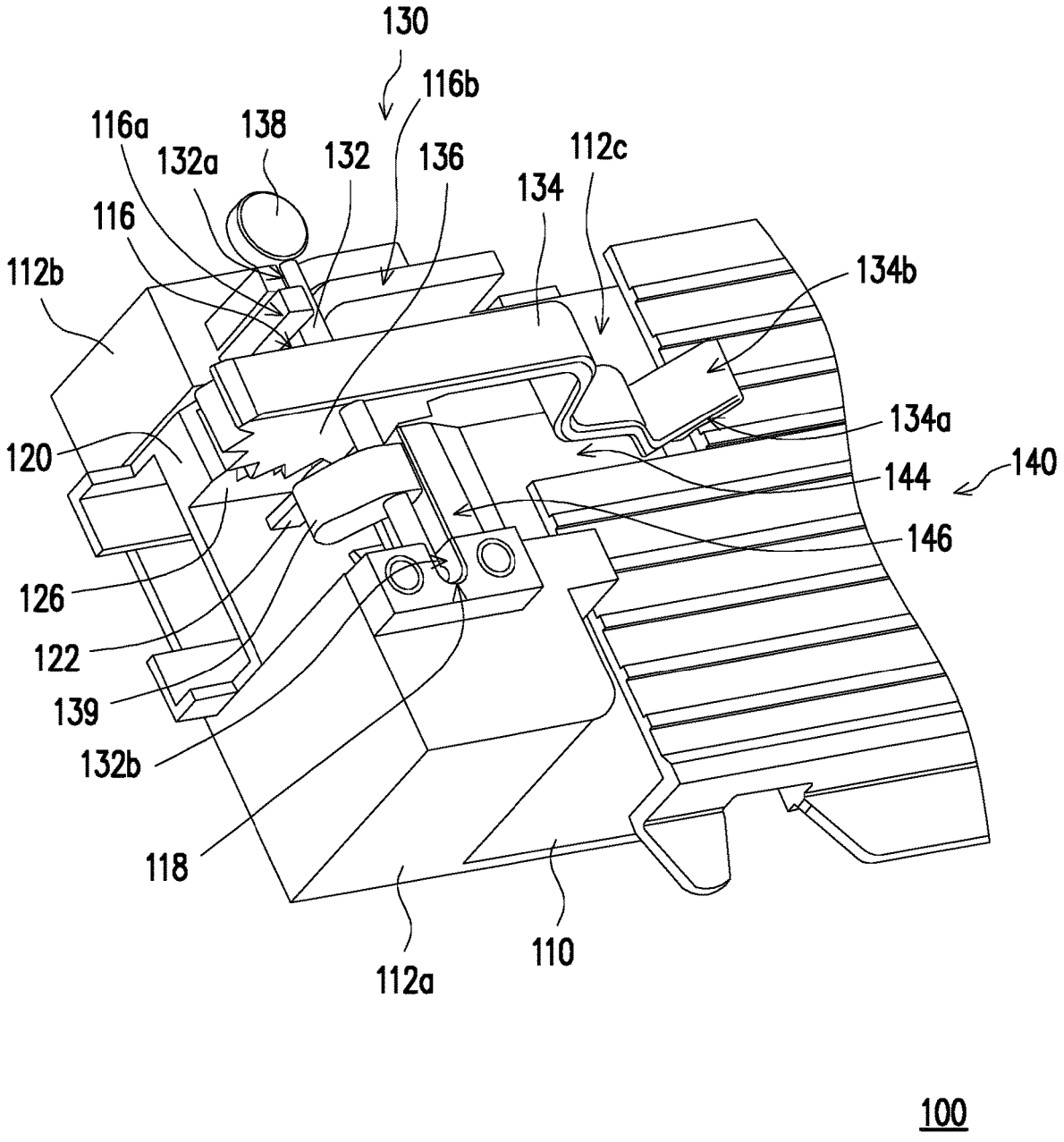
FIG. 2 is a schematic perspective view of the inserting/removing assembly of FIG. 1.
Figure 3:
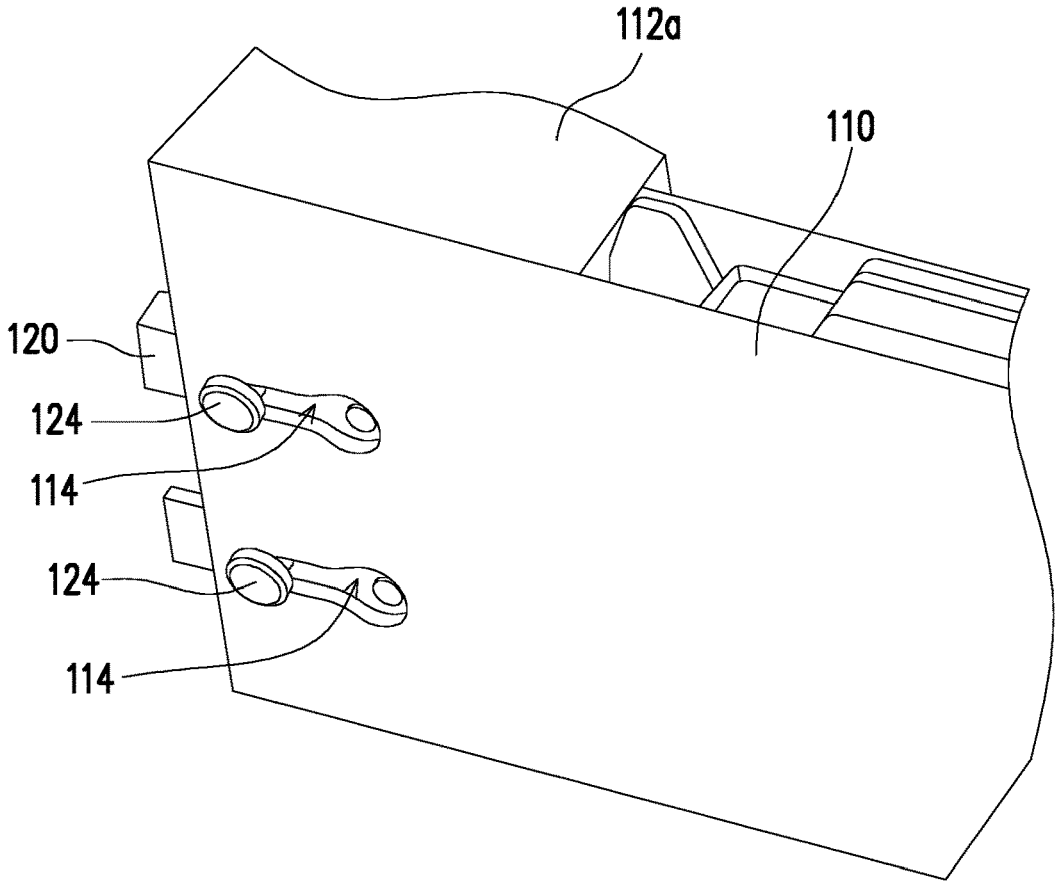
FIG. 3 is a schematic view showing the combination of a base and a carrier of FIG. 1 at another viewing angle.

FIG. 1 is a schematic explosive view of an inserting/removing assembly 100 of an embodiment of the present disclosure. FIG. 2 is a schematic perspective view of the inserting/removing assembly 100 of FIG. 1. FIG. 3 is a schematic view showing the combination of a base 110 and a carrier 120 of FIG. 1 at another viewing angle. Referring to FIG. 1 to FIG. 3, in an embodiment of the disclosure, the inserting/removing assembly 100 includes a base 110, a carrier 120, and a handle 130. The base 110 is configured to carry an inserting/removing part such as a wire 60 having a connector 62 (shown in subsequent figure). The inserting/removing assembly 100 can be applied to an electronic device (such as a server), but the disclosure is not limited thereto. The carrier 120 is disposed on the base 110 and has a fixing portion 122 for fixing the connector 62. The handle 130 is pivoted on the base 110 and connected to the carrier 120, and the carrier 120 is located between the base 110 and the handle 130. Further, the handle 130 is linked to the carrier 120 such that the connector 62 fixed to the fixing portion 122 is moved relative to the base 110 with the carrier 120.

In an embodiment of the disclosure, the base 110 has a pair of position-limiting protrusions 112*a* and 112*b* and a position-limiting interlayer 112*c*. There is a gap between the position-limiting protrusions 112*a* and 112*b*, and the carrier 120 is disposed between the position-limiting protrusions 112*a* and 112*b*. The position-limiting interlayer 112*c* is located on one side of the position-limiting protrusions 112*a* and 112*b*, and the aforementioned inserting/removing part can be carried in the position-limiting interlayer 112*c*. Alternatively, the aforementioned inserting/removing part may also be carried on the surface of the base 110 to omit the use of the position-limiting interlayer 112*c*. However, the present disclosure provides no limitation to the structure of the base 110, which can be adjusted as needed.

Furthermore, one of the base 110 and the carrier 120 has at least one sliding slot 114 (this embodiment employs a pair of sliding slots 114 on the base 110), and the other of the base 110 and the carrier 120 has at least one slider 124 (this embodiment employs a pair of sliders 124 on the carrier 120). The slider 124 is correspondingly embedded in the sliding slot 114 and is movable along the sliding slot 114, such that the carrier 120 moves relative to the base 110 through the cooperation of the sliding slot 114 and the slider 124. Specifically, as shown in FIG. 3, the slider 124 can be a T-shaped pillar, and the sliding slot 114 can have an entrance with a larger size at one end thereof, such that the T-shaped pillar of the slider 124 entering the sliding slot 114 from the entrance is interfered with the sliding slot 114. However, the disclosure provides no limitation to the specific structure of the slider and the sliding slot, and also provides no limitation to the use of the combination of the slider and the sliding slot as long as the carrier 120 is movably disposed on the base 110.

Further, the handle 130 includes a hinge portion 132 and a handle portion 134. The hinge portion 132 is a rod extending in the axial direction, and the handle portion 134 is disposed at a middle portion of the hinge portion 132. The handle 130 is pivotally disposed on the position-limiting protrusions 112*a* and 112*b* of the base 110 through the hinge portion 132, such that the handle portion 134 disposed at the middle portion of the hinge portion 132 corresponds to the carrier 120. In this manner, the handle 130 can rotate relative to the base 110 along the axial direction (i.e., extending direction of the hinge portion 132) of the hinge portion 132 about the hinge portion 132 as the axis through the handle portion 134 to drive the carrier 120 to move relative to the base 110.

Specifically, the hinge portion 132 includes a first end 132*a* and a second end 132*b* opposite to each other, and the handle portion 134 is disposed between the first end 132*a* and the second end 132*b*. The base 110 has an engaging groove 116 and an engaging slot 118, which are respectively disposed on the position-limiting protrusions 112*b* and 112*a*. Specifically, although FIG. 1 shows that the engaging slot 118 is fixed to the position-limiting protrusion 112*a* through a locking part after being disposed in another detachable component, in other embodiments not shown, the engaging slot 118 can be directly formed on the position-limiting protrusion 112*a*. In this manner, the hinge portion 132 is embedded in the engaging groove 116 by the first end 132*a* and is embedded in the engaging slot 118 by the second end 132*b* and pivotally disposed on the base 110, such that the hinge portion 132 is adapted to rotate relative to the base 110 along the axial direction of the hinge portion 132.

Furthermore, the engaging groove 116 has a pair of elastic sidewalls 116*a* and 116*b*, and the first end 132*a* of the hinge portion 132 is a rod shape and thus can be embedded into the engaging groove 116 by pressing the elastic sidewalls 116*a* and 116*b*, thereby the first end 132*a* of the hinge portion 132 can be clamped between the elastic sidewalls 116*a* and 116*b* and allows the first end 132*a* to rotate along the axial direction. Furthermore, the engaging slot 118 has a spherical bottom surface, the second end 132*b* is a spherical end portion and can abut against the spherical bottom surface and abut against the engaging slot 118, and the engaging slot 118 can allow the second end 132*b* to rotate along the axial direction. However, in other embodiments not shown, the positions of the engaging groove 116 and the engaging slot 118 and the arrangement of the first end 132*a* and the second end 132*b* may be reversed or structurally configured in the same manner, the present disclosure is not limited thereto. As such, when the operator operates the handle portion 134 of the handle 130, the handle 130 can be rotated relative to the base 110 about the hinge portion 132 as an axis.

In addition, the carrier 120 has a transmission rack 126 disposed on one side of the fixing portion 122, and the handle 130 has a transmission gear 136 disposed on the handle portion 134 and correspondingly engaged with the transmission rack 126 to be linked to each other, such that the handle 130 drives the carrier 120 to move relative to the base 110 through the cooperation of the transmission gear 136 and the transmission rack 126 when being rotated relative to the base 110. In this manner, when the operator operates the handle portion 134 of the handle 130 such that the handle 130 rotates relative to the base 110 about the hinge portion 132 as the axis, the transmission gear 136 disposed on the handle portion 134 drives the transmission rack 126 to move, such that the carrier 120 moves relative to the base 110 through the cooperation of the slider 124 and the sliding slot 114.

In addition, the handle 130 further includes a fastening portion 134*a* and an opening portion 134*b* adjacent to the fastening portion 134*a*, and is disposed at one end of the handle portion 134 to fix the handle portion 134 or open the handle portion 134 fixed through the fastening portion 134*a*. In other words, the handle 130 is adapted to be fastened to the base 110 (e.g., fastened to the sidewall of the position-limiting interlayer 112*c* but not limited thereto) by the fastening portion 134*a* to fix the handle portion 134 when being rotated to the closed position (the state shown in FIG. 2) relative to the base 110. In this way, it is possible to prevent the handle portion 134 from generating unexpected rotation to drive the carrier 120 and the connector 62 to move and causing the connector 62 to be detached or damaged. In addition, the handle 130 is adapted to release the engaging of the fastening portion 134*a* from the base 110 by pushing the opening portion 134*b* when being fastened to the base 110 by the fastening portion 134*a*, and then move relative to the base 110 toward the open position when the fastened portion 134*a* is released from the base 110. However, the disclosure provides no limitation to the specific structure and configuration of the fastening portion 134*a* and the opening portion 134*b*, which can be adjusted as needed.

Figure 4:
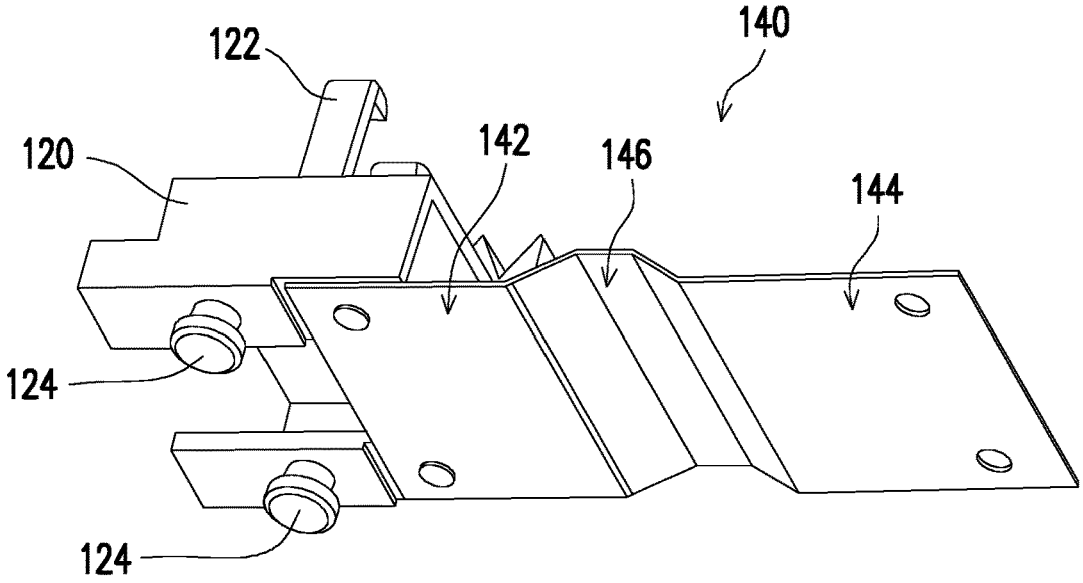
FIG. 4 is a schematic view showing the combination of the carrier and a restoring part of FIG. 1.

FIG. 4 is a schematic view showing the combination of the carrier 120 and a restoring part 140 of FIG. 1. Referring to FIG. 1, FIG. 2 and FIG. 4, in the embodiment, the inserting/removing assembly 100 includes a restoring part 140 disposed on the base 110 and having a first end 142 and a second end 144 opposite to each other and a bending portion 146. The first end 142 is connected to the carrier 120 (shown in FIG. 4) and the second end 144 is fixed on the base 110. The bending portion 146 is located between the first end 142 and the second end 144 and protrudes in a direction opposite to the base 110. As such, with the relative movement between the first end 142 connected to the carrier 120 and the second end 144 fixed on the base 110, it is possible to drive the carrier 120 to move and restore relative to the base 110, and the protruded bending portion 146 can move up and down with the relative movement between the first end 142 and the second end 144.

Further, when assembling the inserting/removing assembly 100, first of all the carrier 120 and the first end 142 of the restoring part 140 are fixed together by the cooperation of a boss and an opening (e.g., the fixation is performed through hot-melt or other fixing means), and then the carrier 120 and the restoring part 140 are disposed on the base 110 together. Specifically, the carrier 120 is disposed between the position-limiting protrusions 112*a* and 112*b* of the base 110, and is movably disposed on the base 110 through the slider 124 and the sliding slot 114 as mentioned above. Subsequently, the second end 144 of the restoring part 140 is fixed on the base 110 by the cooperation of the boss and the opening (e.g., the fixation is performed through hot-melt or other fixing means). When the foregoing inserting/removing part is carried on the base 110, the bending portion 146 of the restoring part 140 can also assist in carrying the inserting/removing part, but the disclosure is not limited thereto (the inserting/removing part may also be directly carried on the base 110). Finally, the handle 130 is pivotally disposed on the position-limiting protrusions 112*a* and 112*b* of the base 110 through the hinge portion 132, and interlinked through the transmission gear 136 engaged with the transmission rack 126. In this manner, the inserting/removing assembly 100 is substantially completed, and the inserting/removing assembly 100 is applied to insertion/removal operation of the inserting/removing part, for example, applied to an insertion/removal operation of a wire 60 in an electronic device 50.

Figure 5:
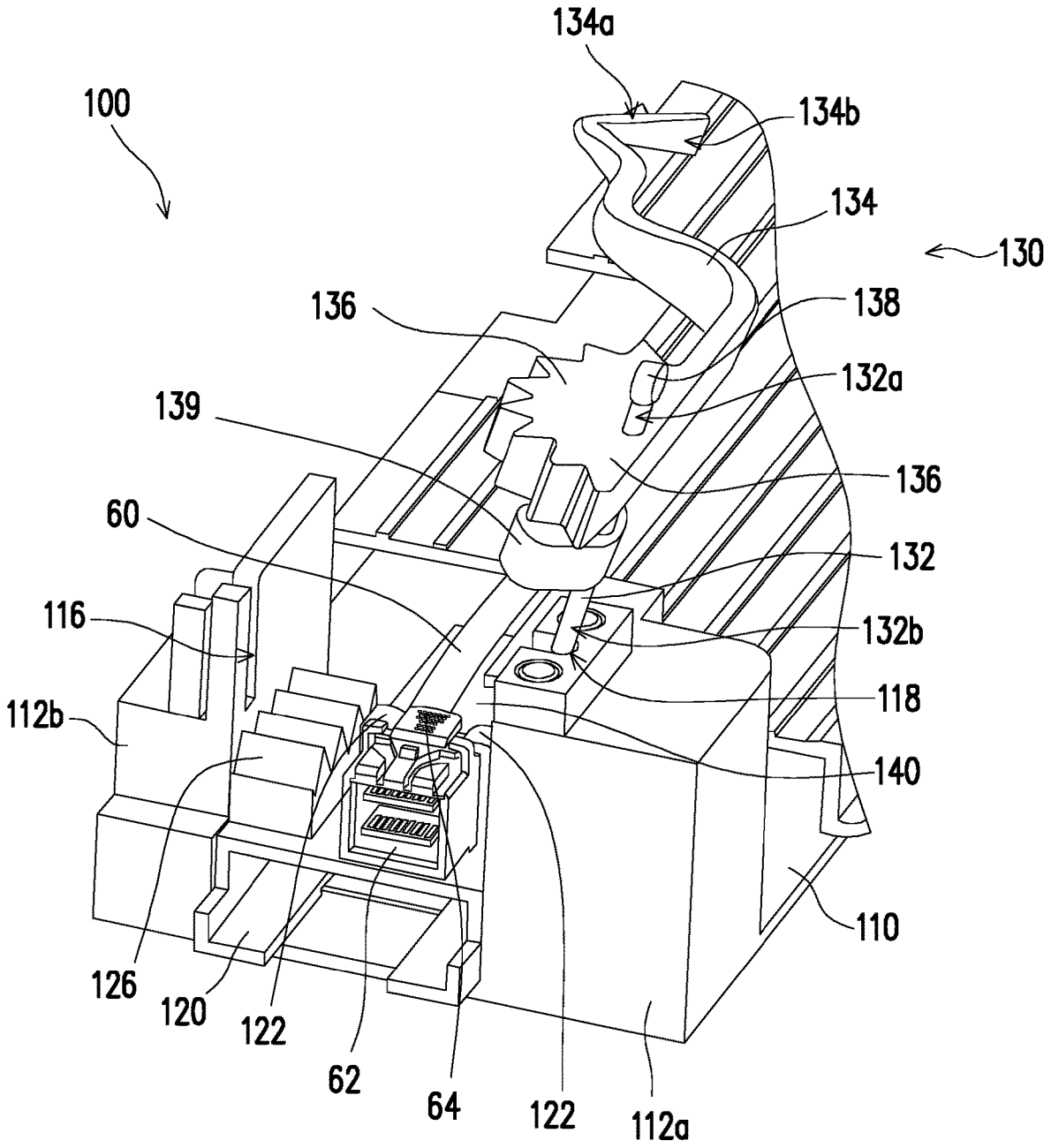
FIG. 5 is a schematic view showing the inserting/removing assembly of FIG. 1 in a first operation state.
Figure 6:
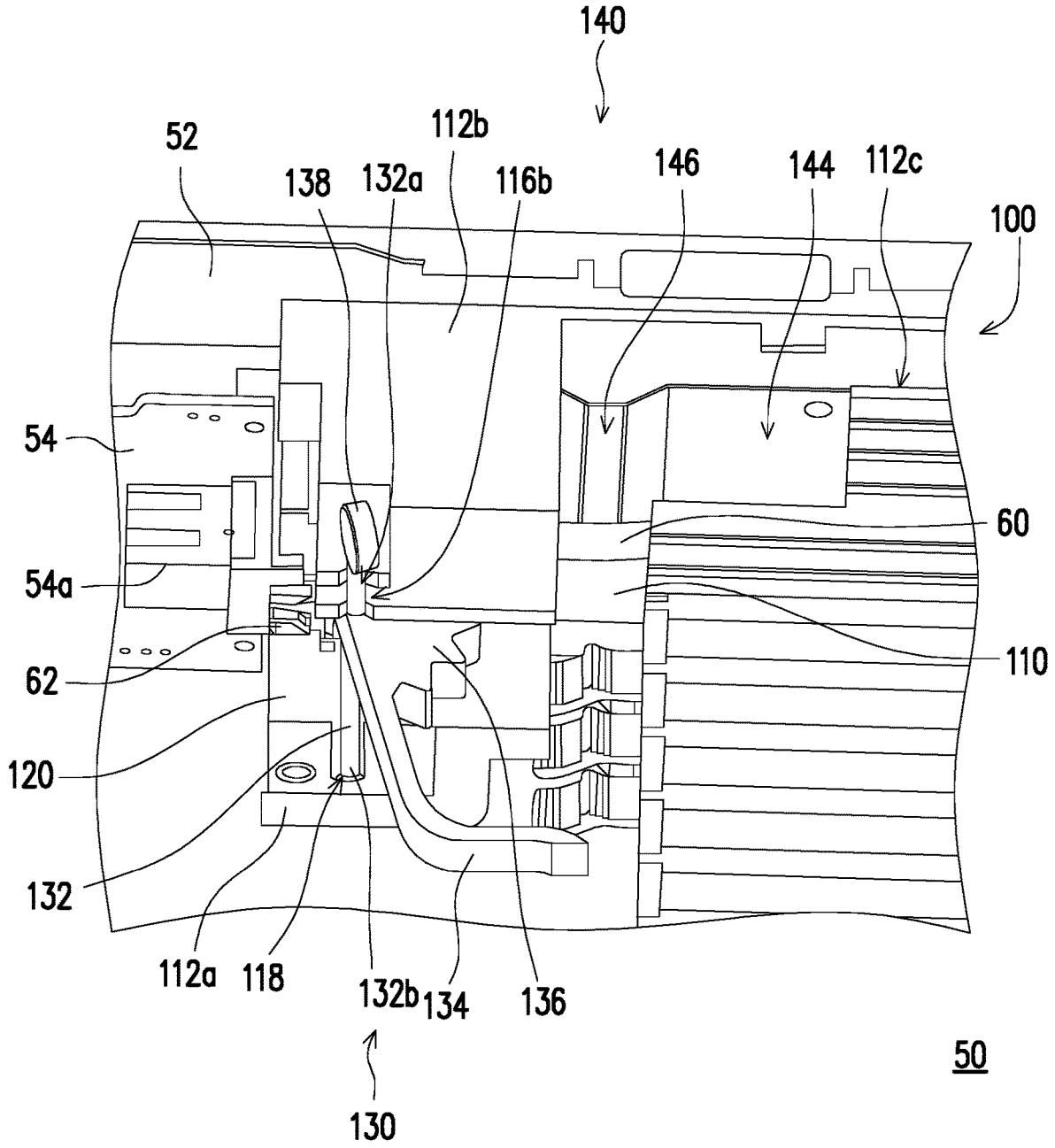
FIG. 6 is a schematic view showing the inserting/removing assembly of FIG. 1 in a second operation state.
Figure 7:
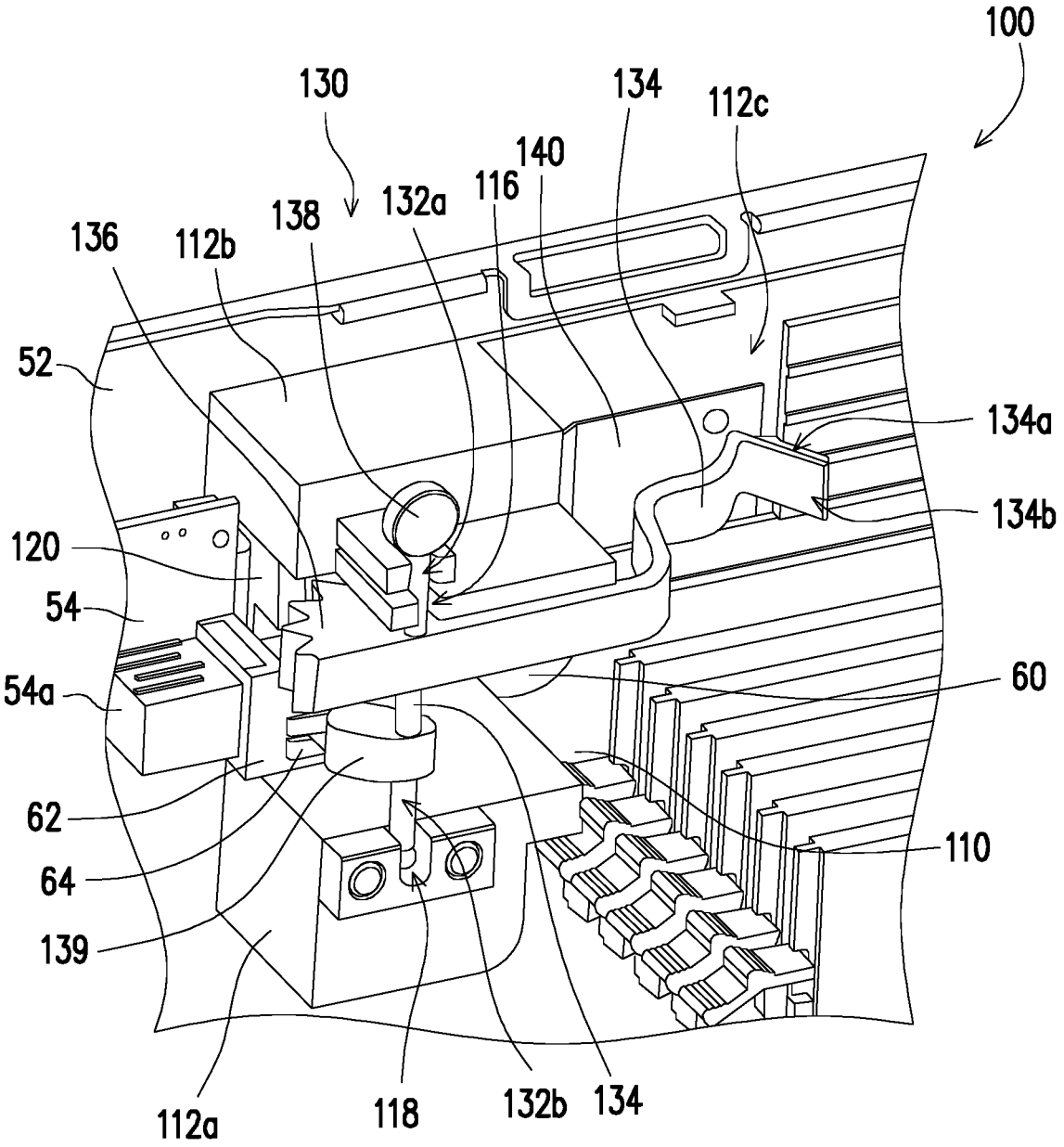
FIG. 7 is a schematic view showing the inserting/removing assembly of FIG. 1 in a third operation state.

FIG. 5 is a schematic view showing the inserting/removing assembly 100 of FIG. 1 in a first operation state. FIG. 6 is a schematic view showing the inserting/removing assembly 100 of FIG. 1 in a second operation state. FIG. 7 is a schematic view showing the inserting/removing assembly 100 of FIG. 1 in a third operation state. The manner in which the inserting/removing assembly 100 is assembled to the electronic device 50 and the operation method of the inserting/removing assembly 100 will be described below with reference to FIG. 1 and FIG. 2 combined with FIG. 5-FIG. 7.

First, in the embodiment, the electronic device 50 includes a housing 52, a card-like electronic component 54, and the inserting/removing assembly 100 (as shown in FIG. 6 and FIG. 7). The electronic device 50 is, for example, a server, but is not limited thereto. The card-like electronic component 54 is detachably disposed in the housing 52, for example, disposed on the sidewall of the housing 52, and has a connecting portion 54*a*, but is not limited thereto. The inserting/removing assembly 100 is disposed in the housing 52 and adjacent to the card-like electronic component 54. The method of disposing the inserting/removing assembly 100 on the housing 52 is, for example, fixing the rear surface of the base 110 to the housing 52 (for example, fixing by the cooperation of the T-shaped pillar and the elastic engaging slot or other fixing means), and is disposed in the housing 52. This action can be performed after the inserting/removing assembly 100 has been assembled, or during assembly of the inserting/removing assembly 100 (e.g., when the handle 130 has not been disposed on the base 110). In addition, the card-like electronic component 54 can be disposed in the housing 52 after the inserting/removing assembly 100 is disposed on the housing 52, or can also be disposed in the housing 52 before the inserting/removing assembly 100 is disposed on the housing 52. Preferably, the inserting/removing assembly 100 can be disposed in the housing 52 in advance, and then the card-like electronic component 54 is disposed into the housing 52 as needed (for example, after being inserted into another slot (not shown) disposed on the mainboard of the housing 52, the wire 60 as the inserting/removing part is connected to the card-like electronic component 54 or removed from the card-like electronic component 54 through the inserting/removing assembly 100 (as shown in FIG. 5 to FIG. 7)), but the disclosure is not limited thereto and can be adjusted as needed.

Referring to FIG. 5, in the embodiment, when the inserting/removing assembly 100 has been disposed in the housing 52 and the insertion operation of the wire 60 is to be performed, first, the handle 130 is removed from the carrier 120 to facilitate disposing the wire 60 on the fixing portion 122 on the carrier 120. Specifically, the first end 132*a* of the hinge portion 132 protrudes beyond the engaging groove 116 in the axial direction. On this occasion, the handle 130 further includes an operation portion 138 which is disposed on a portion of the first end 132*a* of the hinge portion 132 that protrudes beyond the engaging groove 116 to open the hinge portion 132 by operating the operation portion 138. As such, the handle 130 is adapted to push the first end 132*a* out of the engaging groove 116 through pushing the operation portion 138, and make the hinge portion 132 to rotate relative to the base 110 along the axial direction of the hinge portion 132 with the second end 132*b* (spherical end portion) as the supporting point to open the hinge portion 132, such that the first end 132*a* move away from the carrier 120 (as shown in FIG. 5). However, the disclosure provides no limitation to the configuration of the operation portion 138, which can be adjusted as needed.

Therefore, the manner in which the handle 130 is removed from the carrier 120 may be a manner of removing the overall handle 130 from the base 110 to expose the carrier 120, or may be a aforementioned manner of moving only a part of the handle 130 to expose the carrier 120 as long as the operation of disposing the connector 62 of the wire 60 on the fixing portion 122 of the carrier 120 is not blocked by the handle 130.

In addition, the fixing portion 122 includes a pair of hooks extending outward from the carrier 120. Therefore, the fixing portion 122 is adapted to be locked to two opposite sides of the connector 62 through the hooks and to fix the connector 62, and the fixing portion 122 does not affect the connector 62 in performing the subsequent insertion/removal operation, but the disclosure provides no limitation to the specific implementation method of the fixing portion 122, which can be adjusted as needed. After the connector 62 of the wire 60 is disposed on the fixing portion 122, the hinge portion 132 is reversely rotated in the radial direction relative to the base 110 with the second end 132*b* as a supporting point, such that the first end 132*a* is embedded into the engaging groove 116 again (see FIG. 6). On this occasion, the handle 130 is in the closed position, and the carrier 120 and the connector 62 are in the removing position, and the transmission gear 136 of the handle 130 is engaged with the transmission rack 126 of the carrier 120. However, in other embodiments not shown, it may be selected that the overall handle 130 is removed from the base 110. After the wire 60 is installed, the overall handle 130 is reinstalled on the base 110, the disclosure is not limited thereto.

Furthermore, the card-like electronic component 54 can be disposed in another slot (not shown) on the mainboard in the housing 52 before the wire 60 is fixed on the fixing portion 122 with the connector 62, or can be disposed in another slot (not shown) on the mainboard in the housing 52 after the wire 60 is fixed on the fixing portion 122 through the connector 62. Under the circumstances where the wire 60 is fixed on the fixing portion 122 through the connector 62 and the card-like electronic component 54 is disposed in another slot (not shown) on the mainboard in the housing 52, the wire 60 can move relative to the base 110 from the removing position (shown in FIG. 6) to the inserting position (shown in FIG. 7) through the handle 130 driving the carrier 120 such that the connector 62 is connected to the connecting portion 54*a* of the card-like electronic component 54. Further, the handle 130 is rotated from the open position to the closed position relative to the base 110 with the hinge portion 132 as an axis, such that the carrier 120 is moved relative to the base 110 from the removing position to the inserting position through the transmission of the transmission gear 136 and the transmission rack 126 as well as the cooperation of the slider 124 and the sliding slot 114, such that the restoring part 140 is stretched through the movement of the carrier 120. The wire 60 that is disposed in a curved manner along the bending portion 146 of the restoring part 140 is moved up and down with the restoring part 140, and therefore the connector 62 fixed on the fixing portion 122 and the first half portion of the wire 60 (i.e., the portion of the wire 60 connected to the connector 62) are moved forward along with the stretched bending portion 146 that moves downward in a curved manner; further, the connector 62 is inserted into the connecting portion 54*a* of the card-like electronic component 54 and changed from the state shown in FIG. 6 into the state shown in FIG. 7. In the state shown in FIG. 7, the connector 62 of the wire 60 is inserted into the connecting portion 54*a* of the card-like electronic component 54, thereby electrically connecting the wire 60 to the card-like electronic component 54. In this manner, the wire 60 and the card-like electronic component 54 can be connected through the inserting/removing assembly 100 in a simple and labor-saving manner.

In addition, when the wire 60 or the card-like electronic component 54 needs to be replaced or reassembled, the wire 60 can move relative to the base 110 from the inserting position (as shown in FIG. 7) to the removing position (shown in FIG. 6) through the handle 130 driving the carrier 120, such that the connector 62 is disconnected from the connecting portion 54*a* of the card-like electronic component 54. Further, the handle 130 is rotated from the closed position to the open position relative to the base 110 about the hinge portion 132 as an axis, such that the carrier 120 is moved relative to the base 110 from the inserting position to the removing position through the transmission of the transmission gear 136 and the transmission rack 126 as well as the cooperation of the slider 124 and the sliding slot 114. In the meantime, the restoring part 140 is restored by releasing the tensile force to drive the carrier 120 to move, and the wire 60 that is disposed in a curved manner along the bending portion 146 of the restoring part 140 is moved up and down with the restoring part 140, and therefore the connector 62 fixed on the fixing portion 122 and the first half portion of the wire 60 (i.e., the part of the wire 60 connected to the connector 62) is moved backward with the restored bending portion 146 that is moved upward in a curved manner, such that the connector 62 fixed on the fixing portion 122 is removed from the card-like electronic component 54 and changed from the state shown in FIG. 7 to the state shown in FIG. 6. In this manner, the wire 60 and the card-like electronic component 54 can be separated through the inserting/removing assembly 100 in a simple and labor-saving manner. Subsequently, the operator can remove the card-like electronic component 54 from the housing 52 as needed, and can further open the handle 130 (for example, by rotating the hinge portion 132 relative to the base 110 along the radial direction with the second end 132*b* as the supporting point such that the first end 132*a* is moved out from the engaging groove 116 and away from the carrier 120) and then disassemble the connector 62 of the wire 60 from the fixing portion 122 like the state shown in FIG. 5.

Further, in the present embodiment, the connector 62 of the wire 60 has a push switch 64 (shown in FIG. 5 and FIG. 7), for example, a spring projecting outward. When the connector 62 is connected to the connecting portion 54*a* of the card-like electronic component 54, the push switch 64 is embedded into the connecting portion 54*a* and interferes with the inside of the connecting portion 54*a*, thereby preventing the connector 62 from being unexpectedly withdrawn from the connecting portion 54*a* of the card-like electronic component 54 due to the wire 60 pulled by external force. Therefore, the handle 130 of the present embodiment has a cam 139 disposed on the handle portion 134 and corresponding to the fixing portion 122 and the push switch 64 of the connector 62 on the fixing portion 122, such that the cam 139 is driven by operating the handle 130. As such, when the handle 130 is rotated relative to the base 110 from the closed position toward the open position, the handle 130 can push the push switch 64 of the connector 62 fixed to the fixing portion 122 through the cam 139. However, in other embodiments not shown, other structures similar to the cam 139 may be used to withdraw the push switch 64, and the cam 139 may be omitted in the embodiment where the push switch is not provided. The disclosure provides no limitation to the implementation method and configuration of the cam 139, and can be adjusted as needed.

In summary, the inserting/removing assembly of the present disclosure is designed by pivoting the handle on the base and the handle is linked to the carrier, such that the carrier located between the base and the handle is driven by the handle and moved relative to the base. In this way, when the inserting/removing part is carried on the base and the connector of the inserting/removing part is fixed on the fixing portion of the carrier, by operating the handle, it is possible to drive the connector fixed on the fixing portion to move relative to the base with the carrier and perform the insertion/removal operation of the inserting/removing part, for example, by making the connector of the inserting/removing part to be inserted into and connected to the card-like electronic component disposed in the housing. In addition, the handle may further be provided with a fastening portion disposed at one end of the handle portion to fix the handle portion, thereby preventing the handle portion from being unexpectedly rotated to drive the carrier and the connector to move to cause the connector to fall off or be damaged. Thus, the inserting/removing assembly of the present disclosure can perform the insertion and removal operation of the inserting/removing part in an easy and labor-saving manner.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. An inserting/removing assembly, comprising:

a base, configured to carry an inserting/removing part having a connector;

a carrier, disposed on the base and having a fixing portion configured to fix the connector; and a handle, pivotally disposed on the base, and the carrier located between the base and the handle, wherein the handle is linked with the carrier such that the connector fixed on the fixing portion is moved relative to the base with the carrier.

2. The inserting/removing assembly according to claim 1, further comprising a restoring part disposed on the base and having a first end and a second end opposite to each other, wherein the first end is connected to the carrier and the second end is fixed on the base.

3. The inserting/removing assembly according to claim 2, wherein the restoring part comprises a bending portion located between the first end and the second end and protrudes toward a direction opposite to the base.

4. The inserting/removing assembly according to claim 1, wherein one of the base and the carrier has at least one sliding slot, the other one of the base and the carrier has at least one slider, the slider is correspondingly embedded into the sliding slot and is movable along the sliding slot.

5. The inserting/removing assembly according to claim 1, wherein the handle comprises a hinge portion and a handle portion, the handle is pivotally disposed on the base through the hinge portion, and is rotated relative to the base through the handle portion with the hinge portion as an axis to drive the carrier to move relative to the base.

6. The inserting/removing assembly according to claim 5, wherein the carrier has a transmission rack disposed on one side of the fixing portion, the handle has a transmission gear disposed on the handle portion and correspondingly engaged with the transmission rack to be linked with each other.

7. The inserting/removing assembly according to claim 5, wherein the handle further comprises a fastening portion disposed at one end of the handle portion to fix the handle portion.

8. The inserting/removing assembly according to claim 7, wherein the handle further comprises an opening portion disposed at one end of the handle portion and adjacent to the fastening portion to open the handle portion fixed through the fastening portion.

9. The inserting/removing assembly according to claim 5, wherein the handle has a cam disposed on the handle portion and corresponding to the fixing portion to drive the cam by operating the handle.

10. The inserting/removing assembly according to claim 5, wherein the hinge portion extends along an axial direction and comprises a first end and a second end opposite to each other, the base has an engaging groove and an engaging slot, the hinge portion is embedded into the engaging groove by the first end and embedded into the engaging slot by the second end and pivotally disposed on the base.

11. The inserting/removing assembly according to claim 10, wherein the engaging groove has a pair of elastic sidewalls, the first end is clamped between the pair of elastic sidewalls.

12. The inserting/removing assembly according to claim 10, wherein the engaging slot has a spherical bottom surface, and the second end abuts against the spherical bottom surface.

13. The inserting/removing assembly according to claim 10, wherein the first end protrudes beyond the engaging groove along the axial direction to open the hinge portion by operating the first end with the second end as a supporting point.

14. The inserting/removing assembly according to claim 13, wherein the handle further comprises an operation portion disposed on a portion of the first end of the hinge portion protruded beyond the engaging groove, thereby operating the operation portion to open the hinge portion.

15. The inserting/removing assembly according to claim 1, wherein the fixing portion comprises a pair of hooks extending outward from the carrier, the fixing portion is adapted to be locked to two opposite sides of the connector through the pair of hooks.

16. The inserting/removing assembly according to claim 1, wherein the base has a pair of position-limiting protrusions and a position-limiting interlayer, the carrier is disposed between the pair of position-limiting protrusions, the position-limiting interlayer is located on one side of the pair of position-limiting protrusions to carry the inserting/removing part.

* * * * *